US005606938A

United States Patent [19]

Rowe

[11] Patent Number: 5,606,938

[45] Date of Patent: Mar. 4, 1997

[54] TRI-LOBED CAM ENGINE

[75] Inventor: John A. Rowe, Whitby, Canada

[73] Assignee: Tritec Power Systems Ltd., Toronto, Canada

[21] Appl. No.: 578,297

[22] Filed: Dec. 26, 1995

Related U.S. Application Data

[63] Continuation-in-part of Ser. No. 265,357, Jun. 24, 1994, Pat. No. 5,529,029.

[51] Int. Cl.[6] ..... F02B 75/22

[52] U.S. Cl. ..... 123/54.3; 123/55.3

[58] Field of Search ..... 123/54.3, 55.3, 123/55.7, 197.1, 54.2, 55.1

[56] References Cited

U.S. PATENT DOCUMENTS

| | | | |
|---|---|---|---|
| 793,270 | 6/1905 | Blomgren | 123/55.3 |
| 1,309,257 | 7/1919 | Martens | 123/54.3 |
| 1,792,062 | 2/1931 | Barnum | 123/55.3 |
| 1,810,688 | 6/1931 | Toce et al. | 123/55.3 |
| 1,965,548 | 7/1934 | Hart | 123/54.3 |
| 2,124,604 | 7/1938 | Bidwell | 123/55.3 |
| 3,584,610 | 6/1971 | Porter | 123/55.3 |
| 4,038,949 | 8/1977 | Farris | 123/54.3 |
| 4,697,552 | 10/1987 | Kolev | 123/55.3 |

FOREIGN PATENT DOCUMENTS

| | | | |
|---|---|---|---|
| 46-42527 | 12/1971 | Japan | 123/54.3 |

*Primary Examiner*—David A. Okonsky
*Attorney, Agent, or Firm*—Kenneth M. Garrett

[57] ABSTRACT

In an engine having free floating reciprocating pistons each with a cam follower which bears on a tri lobed cam, the pistons are arranged in one or more banks of four pistons each of which extends over an angular interval of 90°. Where two banks of four pistons are utilized, the banks may be separated by an angular interval of 30° or 90°. The tri-lobed cam may be sinuously shaped with different profiles according to the desired characteristics of the engine.

16 Claims, 10 Drawing Sheets

TRI-LOBED CAM ENGINE

RELATED APPLICATION

This application is a continuation in part of application Ser. No. 08/265,357, filed Jun. 24, 1994, now U.S. Pat. No. 5,529,029 the contents of which are incorporated herein by reference thereto as fully as if they were set forth at length herein.

FIELD OF INVENTION

This invention relates to reciprocating piston engines which include a tri-lobed cam for converting the reciprocating piston movement to rotary movement of vice versa depending upon whether the engine is used in a motor or compressor mode.

BACKGROUND OF INVENTION

Reciprocating piston tri-lobed cam engines are disclosed in the following patents:

U.S. Pat. Nos.:

1,765,237; 1,792,062, 1,810,688 2,124,604; 4,697,552

In each of the foregoing patents a pair of diametrically opposed pistons are provided which are coupled together in push-pull relationship by an inextensible link. Each piston has a cam-follower, the link serving to maintain the cam-followers in contact with the cam at all positions of rotation thereof. The coupling together of the pistons in this manner necessitates the shaping of the tri-lobed cam such that the dimension between diametrically opposed portions is substantially constant. Generally speaking, such shaping includes a flattening of the lobes of the cam and the formation of a concavity between adjacent pairs of lobes. These engines have a relatively large angular interval over which they are not self-starting when operated using an externally generated source of pressurized gas, for example when operated as external combustion engines, steam engines and compressed air engines.

In U.S. Pat. No. 1,203,855 there is disclosed a tri-lobed cam engine wherein the pistons are not connected together, whereby they are free-floating. The cam of this engine is asymmetrically shaped, whereby the engine would be suited for operation in one direction only. Moreover, the interaction between the cam-followers and the cam would generate a severe reactive force which urges the piston into contact with the wall of the cylinder in which it reciprocates, promoting a rapid wear.

For certain purposes it may be preferred that the cam be asymmetrical, while retaining the self-starting operation of the engine when operated as an external combustion motor or the like.

In the aforementioned patent application there is disclosed improvements to tri-lobed cam engines which overcome at least in part the above mentioned disadvantages. Such improved engines may be self-starting when operated as external combustion motors, and utilize free floating pistons with bearings to reduce the inter-reactive forces between the piston and cylinder wall, and which may be operated in either forward or reverse direction. In addition, a simple modular design of such improved engines permits the number of cylinders to be easily varied, or the cylinders removed or replaced, with four cylinder and eight cylinder engine units being disclosed.

More particularly, the improved engine described in the above mentioned patent application, comprises a housing with a shaft and tri-lobed cam, and four free-floating piston means disposed on the housing in equi-spaced relationship. Each piston means includes a cylinder and a free floating piston for reciprocal movement within the cylinder and a cam-follower associated with each piston. The cam-follower has associated therewith a guide bearing means and the housing has a track means along which the guide beating means is movable. The guide bearing means serves to reduce cylinder-piston wear by transmitting to the track means reactive forces generated in the cam-follower by the cam, which would otherwise urge the piston into contact with its cylinder.

As a preferred feature, the guide bearing means includes a pair of guide bearings disposed on axially opposed sides of the cam follower, the axial direction of the engine being considered to be that of the engine shaft. Also preferably, the guide bearing means and the cam follower are rotatable and suitably have a collinear axis of rotation.

With the reduction of piston-cylinder interaction and with the rolling motion of the cam follower and associated guide bearing means, the engine is particularly adapted for use as a high torque, essentially oil free air motor for use in the food processing trades.

The four piston means of the engine unit are arranged at ninety degree intervals, with the cylindrical axes of the cylinders intersecting at the axis of the engine shaft, so as to provide a symmetry and reversibility of direction of the engine.

Where eight cylinders are provided in a unit, the cylinders are disposed at forty five degree intervals.

It will be understood that engine units may be coupled together in side by side relationship to form engines having any multiple of four cylinders.

BRIEF SUMMARY OF THE INVENTION

The instant development contemplates improvements to tri-lobed cam engines, which engines may be of a similar nature to those described in the above mentioned patent application, but wherein the cylinders are arranged in banks of four with the cylinders of a bank spaced apart at an angular interval of thirty degrees so as to extend over an angular interval of ninety degrees. In accordance with this improvement, one, two or three of such banks of cylinders may be provided, to form engine units of four, eight or twelve cylinders. Where two banks are utilized, these may be spaced apart by thirty degrees so as to form eight continuously arranged cylinders disposed over an angular interval of two hundred and ten degrees, or alternatively they may be spaced apart by ninety degrees, so as to be opposed. Where twelve cylinders are employed, they will be equispaced over an angular interval of three hundred and sixty degrees. The cylinders of any of the foregoing engines will desirably locate so as to be bisected by a single plane, although they may be axially staggered should this be desired.

The tri-lobed cam may be essentially in the form of an isosceles triangle, or the sides thereof may be sinuously shaped in manners that are hereinafter more particularly described, so as to provide, for example, for an increased piston travel and or to vary the rate of acceleration of the pistons with the angular rotation of the cam, and accordingly the torque output of the engine when used as a motor.

DESCRIPTION OF THE PREFERRED EMBODIMENT

Figure 1:
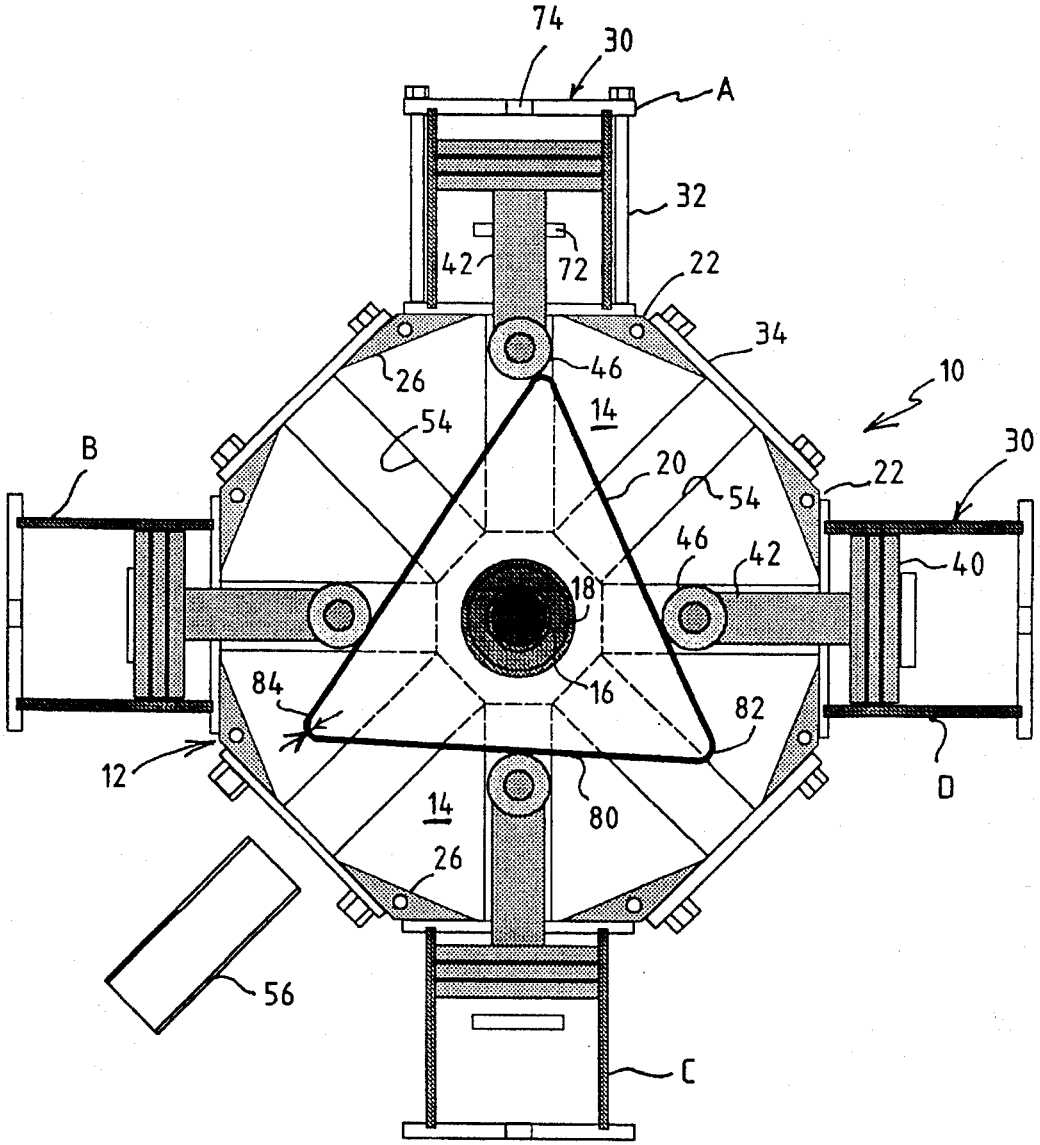
FIG. 1—is a schematic, transverse mid-sectional view of a four cylinder engine unit in accordance with the invention of the aforementioned patent application.
Figure 2:
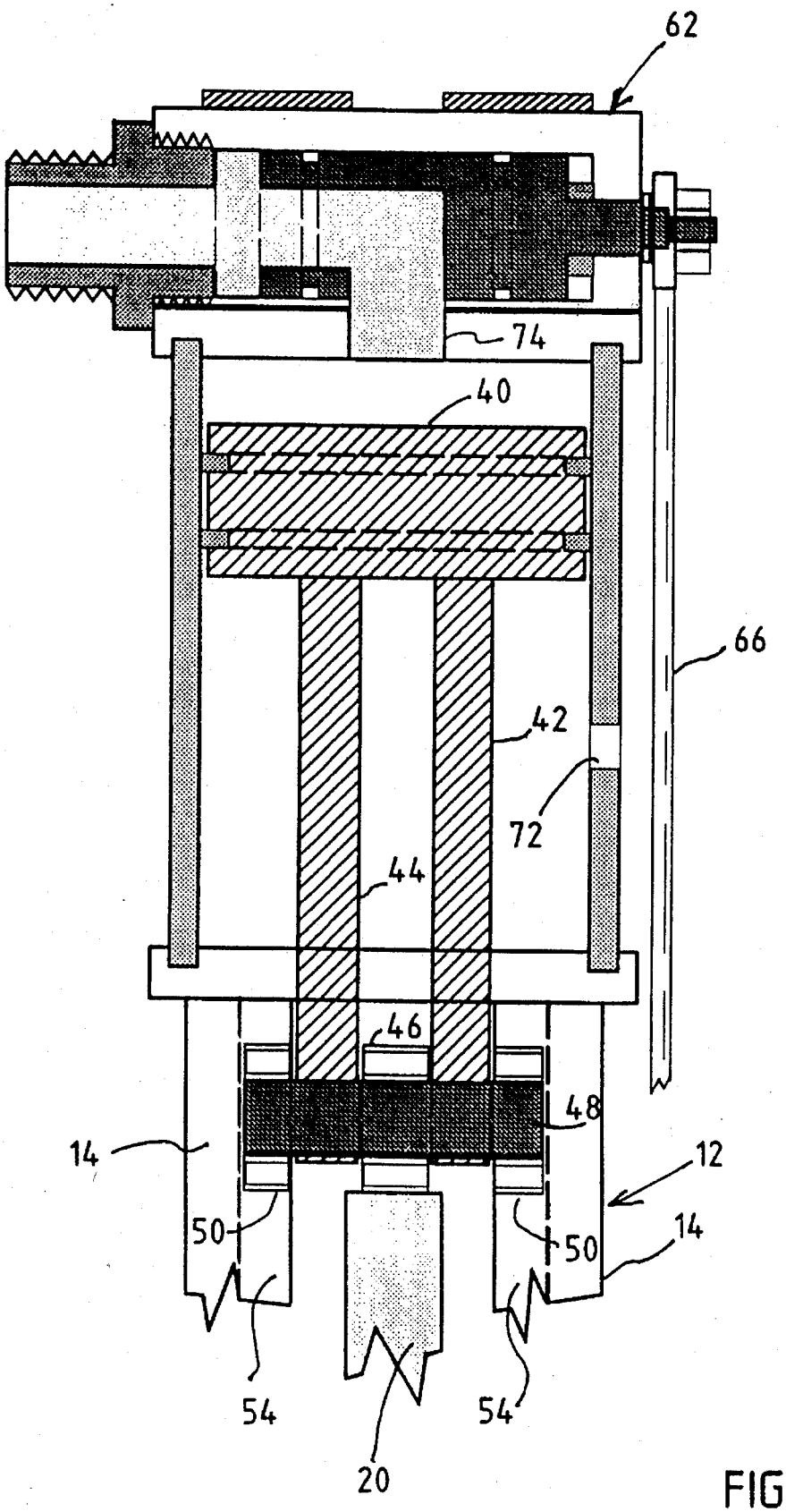
FIG. 2—is a schematic axial mid-sectional view through one cylinder of the engine of FIG. 1, with valve components shown in addition.

Referring to the drawings in detail, an engine in accordance with the invention of the copending application is identified generally by the numeral 10. Engine 10 comprises a housing 12 including a pair of opposed, spaced apart side plates 14 with a shaft 16 mounted therefrom by beatings 18 for rotation. A cam 20 is mounted on shaft 16 for rotation therewith. Housing 12 includes eight facets forming mounts 22 disposed in equi-spaced relationship on a circle centered on the axis of rotation of shaft 16, with stiffening spacers 26 being disposed between the side plates 14 at each adjacent pair of mounts. A cylinder 30 is disposed on alternate ones of mounts 22 and secured thereto by bolts 32 which conveniently screw into side plates 14, those of mounts 22 not having a cylinder disposed thereon being generally closed off by a cap 34. Within each cylinder 30 is disposed a piston 40 from which is rigidly dependent a piston rod 42. Each piston rod 42 has a clevis opening 44 within which is mounted a cam follower 46 on a bearing pin 48 adjacent the distal end of the piston rod. Bearing pin 48 projects outwardly on opposed sides of clevis opening 44 to provide a mount for a pair of guide bearings 50 disposed on axially opposed sides of cam follower 46. Each mount 22 has associated therewith a pair of tracks 54 which are conveniently machined into side plates 14 and along which guide bearings 50 will roll as a piston 40 reciprocates in its cylinder 30. It will be understood that cylinders 30 and tracks 54 and bearing pins 48 are all centred on diameters passing through the axis of rotation of shaft 16.

Engine 10, where in the form of an external combustion motor includes a valve assembly 60 conveniently in the form of a rotating oscillating inlet valve 62 operated by a push rod assembly 64 disposed on the outside of housing 12 in association with each cylinder 30 and which includes a push rod 66 driven by a timing valve cam 68 disposed on engine shaft 16 and secured thereto by key 70. An exhaust port 72 is disposed in the wall of each cylinder 30 and an inlet port 74 in the head thereof.

Cam 20 is generally in the form of an isosceles triangle with rectilinear sides 80 and lobes 82 which are sharply rounded with a radius 84 of approximately 6 mm, which dimension may be relatively independent of the size of cam 20, at least over the range wherein sides 80 have a dimension in the range of about 5 cm to about 50 cm (2 in. to 20 in.). Timing cam 68 has a shape that is generally complementary to that of main cam 20, ie. is in the form of an isosceles triangle, although with the lobes 86 thereof substantially flattened as will be subsequently discussed.

Considering engine 10 operating as a motor from a source (not shown) of expandable gas, and differentiating the cylinders 30 for the purposes of the ensuing description with the letters A, B, C and D, and with the components in their relative positions as shown in FIG. 1, at start-up, assuming the engine valve cam 68 to be adjusted to provide a clockwise movement of shaft 16, the piston 40 of cylinder A will be marginally beyond its top dead center position. The inlet valve 62 to cylinder A will be marginally open, and those to cylinders B, C and D will be closed. Accordingly, the piston 40 of cylinder A will be urged downwardly by the expandable gas introduced into cylinder A, causing cam 20 and shaft 16 therewith to rotate in a clockwise direction. The valve 62 to cylinder A will suitably close when piston 40 of cylinder A has descended approximately one third of its stroke with lobes 86 being shaped accordingly. Concomitantly with the downward movement of the piston of cylinder A, the piston of cylinder B will be urged upwardly, trapping a volume of gas in the cylinder. Ultimately, the piston 40 of cylinder B will assume the position of the piston 40 of cylinder A illustrated in FIG. 1 and the expandable gas will be introduced into the cylinder B. At this time engine 10 will be operating dynamically, and a work output will be generated by the piston 40 of both cylinder A as this moves towards the bottom of its stroke, and the piston of cylinder B. The pistons of cylinders C and D will operate in analogous manner to pistons A and B and in general, when engine 10 is dynamically operational as a motor, two adjacent pistons will provide power on an expansion stroke and two adjacent pistons will be driven by cam 20.

In view of the relatively high torque output from engine 20, shaft 16 may often be coupled directly to a unit to be driven without any intermediate gear box. Where it is desired that the engine of FIG. 1 be operated in an anti-clockwise direction, it is merely required to flip timing cam 68 through 180°. It will be understood that other, somewhat more complex variations may be used for shifting timing cam 68 relative to shaft 16 for reversing the direction of rotation of the engine.

Considering now valve cam 68 to be adjusted to operate engine 10 as a motor turning in an anti-clockwise direction and considering the parts to be in the relative positions as seen in FIG. 1, at start-up the piston of cylinder A will be in a position marginally before top dead center and the inlet valves 62 to cylinders A, C and D will be closed. The inlet valve 62 to cylinder B will be open, urging the piston 40 thereof downwardly, thereby causing cam 20 to rotate in an anti-clockwise direction and shaft 16 therewith. When cam 20 is rotated to a position to urge the piston 40 of cylinder A to its top dead center position, the inlet valve 62 to cylinder A will open and the sequence of operations described above in relation to the engine when operated in a clockwise direction is repeated in reverse.

The rolling action of cam followers 46 and guide bearings 52 and the reduction of side forces on pistons 40 permits engine 10 to be operated under certain conditions without lubrication, or with lubrication provided only through the use of sealed bearings, which is highly advantageous under adverse conditions.

Figure 3:
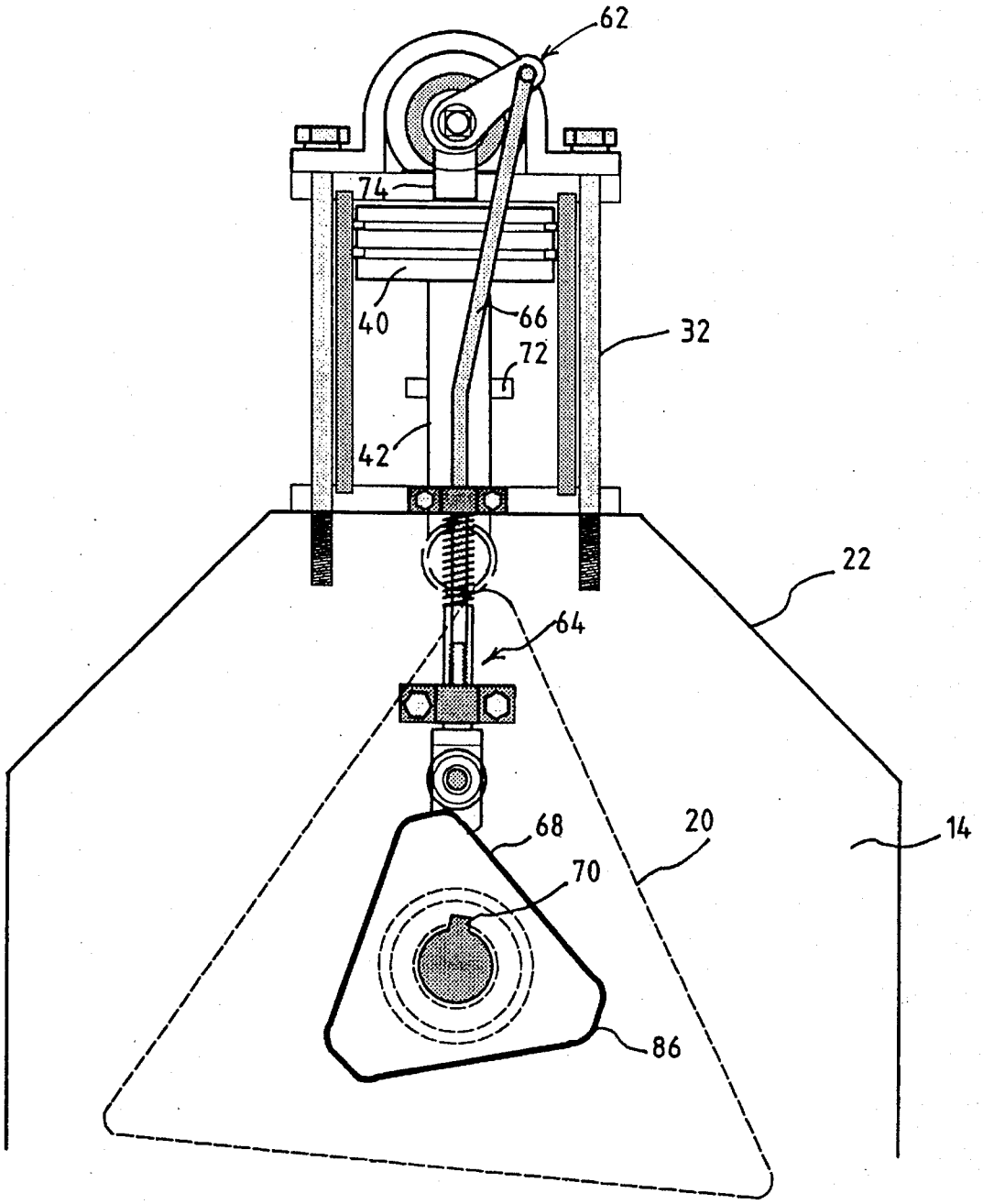
FIG. 3—is a schematic axial elevation showing further detail of a valve arrangement with hidden detail shown in dashed outline.
Figure 4:
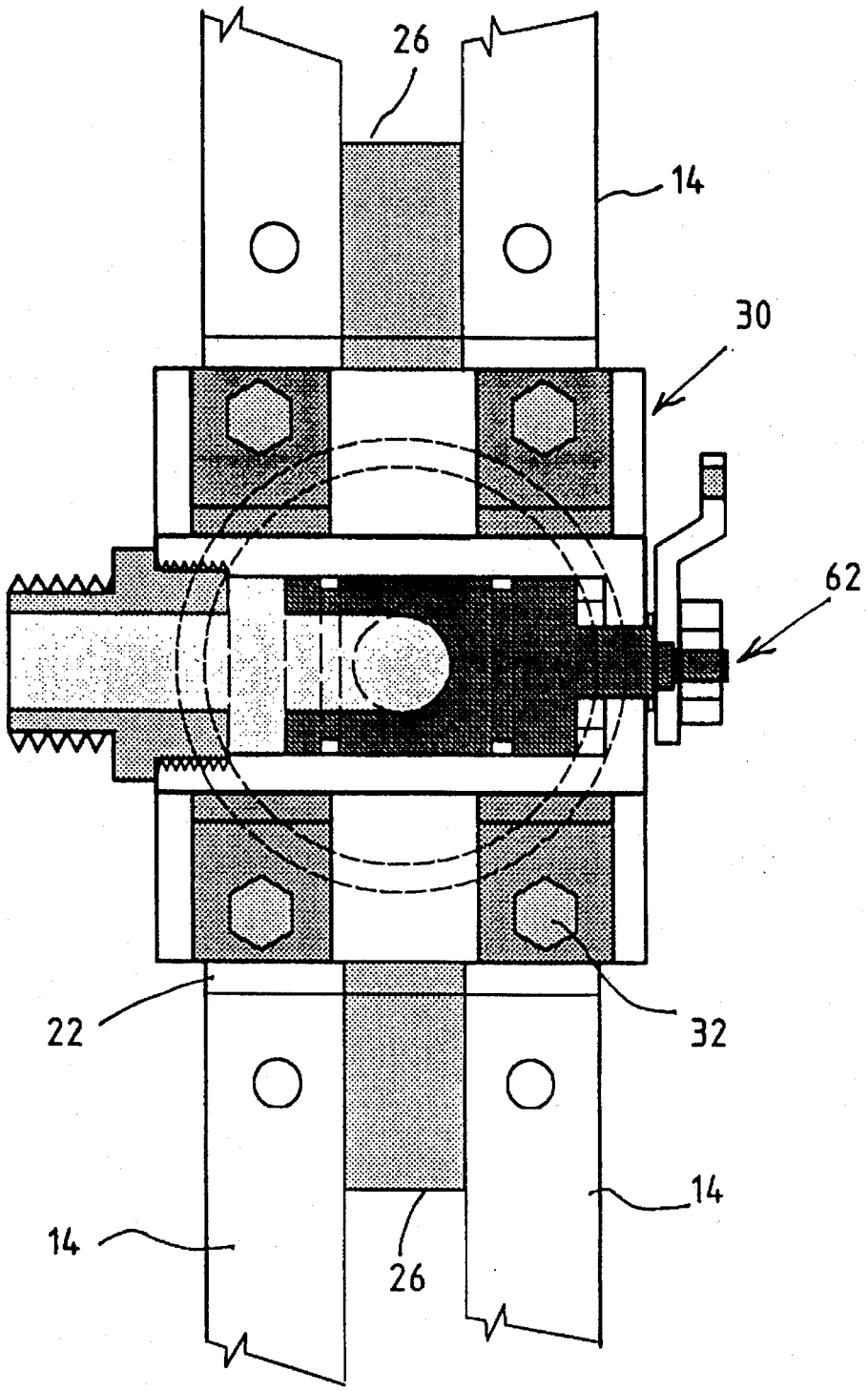
FIG. 4—is similar to FIG. 1, but shows an eight cylinder form of the engine unit.

The maintenance of engine 10 is particularly facilitated due to the free floating action of the pistons 40, which permits the cylinders 30 and pistons 40 to be removed simply by the removal of bolts 32. The conversion of engine 10 to an eight cylinder engine is equally simple, and involves the removal of caps 34 from the engine 10 of FIG. 1 and the securement of cylinders 30 and related components in their place, to form engine unit 110 of FIG. 3.

A four cylinder motor 10 will have twelve power strokes per revolution of shaft 16, and this will be doubled for the eight cylinder motor 110. Accordingly, it will be appreciated that this results in motors having an exceptionally high torque and smooth operation.

Although the materials of construction of engine 10 are not critical, much of the structure thereof, including housing 10 is particularly amenable to manufacture from plastic materials, and it is contemplated that the tracks 54 be lined with replaceable liners 56 to facilitate maintenance.

Figure 5:
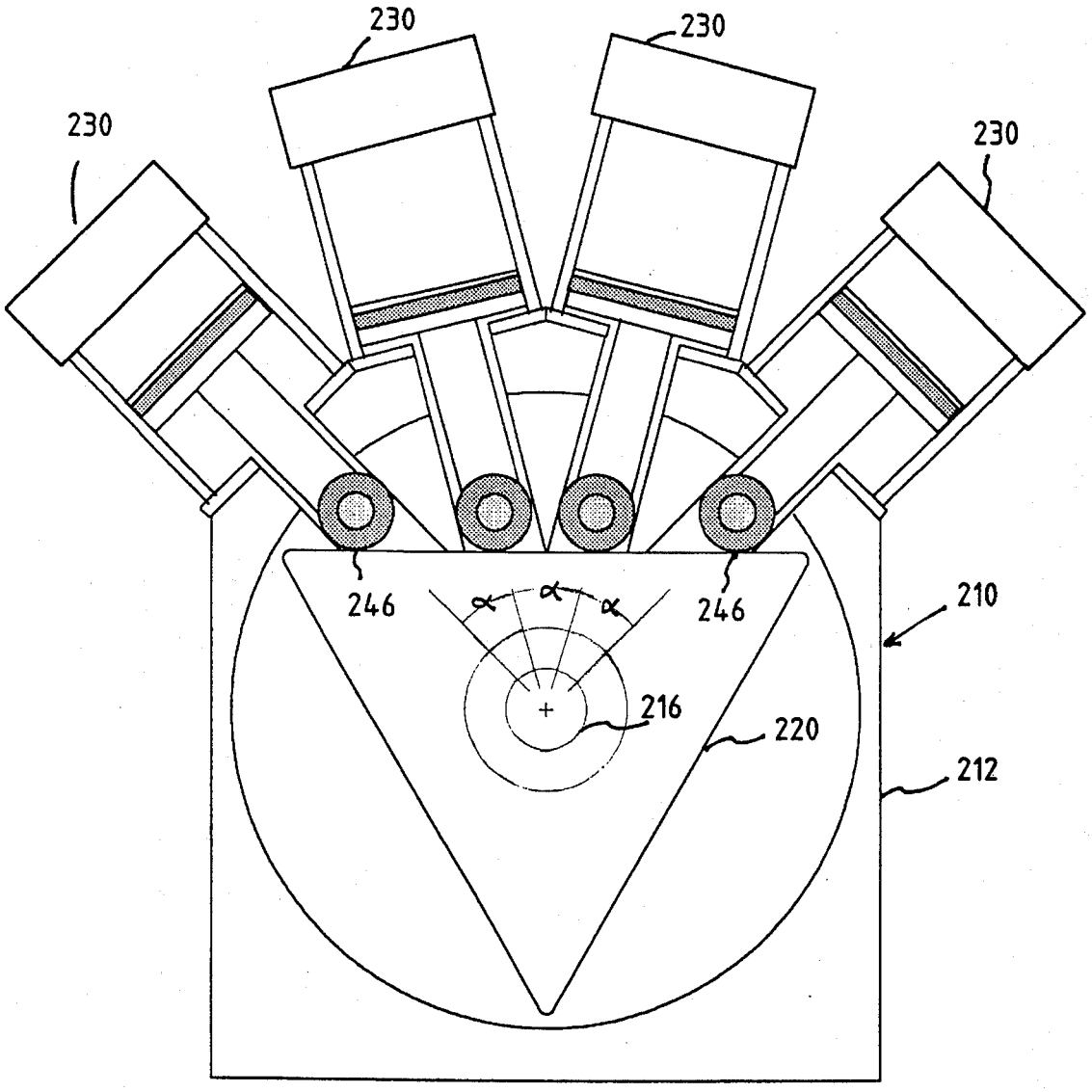
FIG. 5—is similar to FIG. 1, but shows an engine unit with one bank of four cylinders in accordance with the instant improvement.

Referring now to FIG. 5, a motor unit 210 in accordance with the instant improvement comprises a housing 212 with a tri-lobe cam 220 mounted therein for rotary movement about a shaft 216, motor unit 210 further comprises a bank of four cylinders 230 mounted on housing 210 with an angular interval and between adjacent cylinders of the bank equal to 30°, whereby the bank extends over an angular interval of 90°. Other than in the placement of cylinders 30 and 230, motor units 10 and 210 are constructed in a generally identical manner. The valving for motor unit 210 may be generally identical to that which is earlier described in relation to the embodiment of FIG. 1, or any generally equivalent rotary valve, which valves are of common knowledge in the an and not specifically described herein. The operation of motor unit of 210 will become apparent from the ensuing description.

In comparison to motor unit 10, motor unit 210 will be physically smaller for any given cylinder size. The arrangement also has the advantage of being operable as a wet sump unit should this be desired, to permit splash lubrication of cam 220, cam followers 246 and related parts. Alternately, where motor unit 210 is operated using steam as an expansible fluid source, the sump of housing 212 may be enlarged whereby it may serve to collect steam condensate should this be desired. Still further, it will be apparent that the cylinders 230 of motor unit 210 will be more easily accessible for maintenance than those of motor unit 10.

Figure 6:
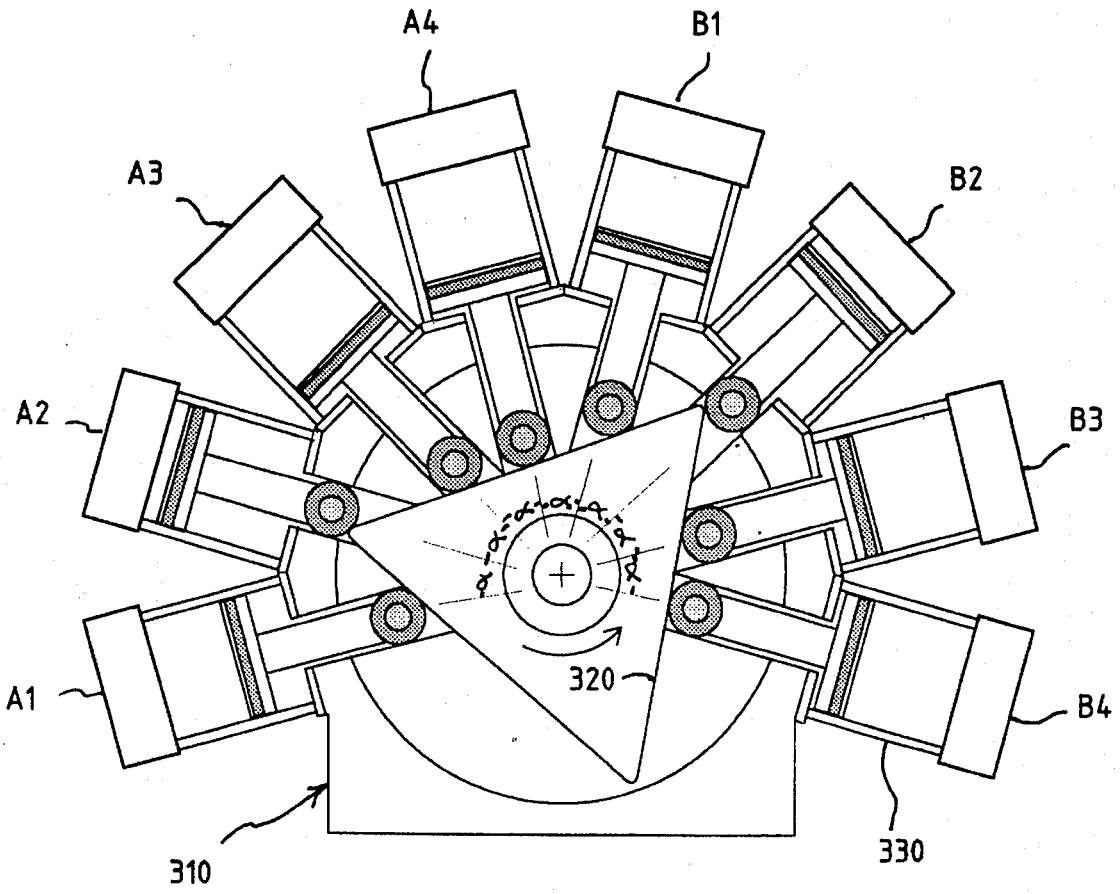
FIG. 6—is similar to FIG. 5, but shows an engine unit with two banks of four cylinders in a first arrangement.

Considering now the motor unit which is identified generally in FIG. 6 by numeral 310, this comprises eight cylinders 330 spaced apart by an angle $\alpha$ equal to 30°, whereby the cylinders extend over an angular interval of 210°. Cylinders 330 are considered for discussion purposes to form two banks A and B each of four cylinders 1–4, and are accordingly labelled A1 through B4.

The operation of motor unit 310 is as follows: Considering the unit to rotate in an anti clockwise manner, cylinders A2 and A3 of bank A will be seen to be on an expansion stroke, while cylinders A1 and A4 of the bank will be on a compression stroke. Similarly cylinders B2 and B3 of bank B will be on an expansion stroke, and cylinders B 1 and B4 on a compression stroke. The geometry of the tri-lobe engines as described herein wherein one or more banks of four cylinders are employed, with each bank of cylinders extending over an angular interval of 90°, is such that at any position of rotation of the tri-lobe cam, two cylinders of any bank will be on an expansion stroke, and two cylinders will be on a compression stroke, in a manner that is wholly analogous to the operation of the four cylinders of engine unit 10 of the first embodiment.

Figure 7:
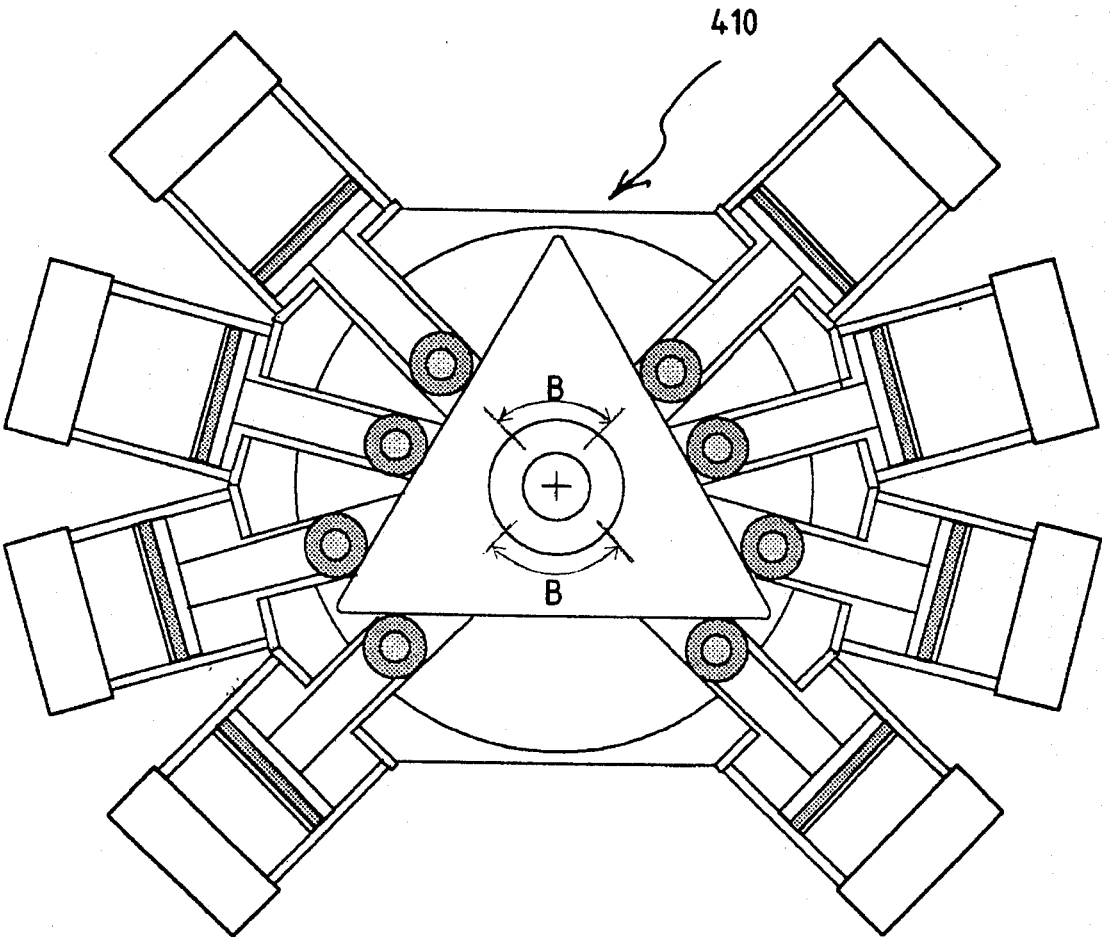
FIG. 7—is similar to FIG. 6, but shows an engine unit with two banks of four cylinders in a second arrangement.

An eight cylinder engine unit is identified in FIG. 7 by the numeral 410, in which embodiment the cylinders are grouped into two banks each extending over an angular interval of 90° and spaced apart by an angular interval $\beta$ equal to 90°, whereby the two banks of cylinders are opposed.

Figure 8:
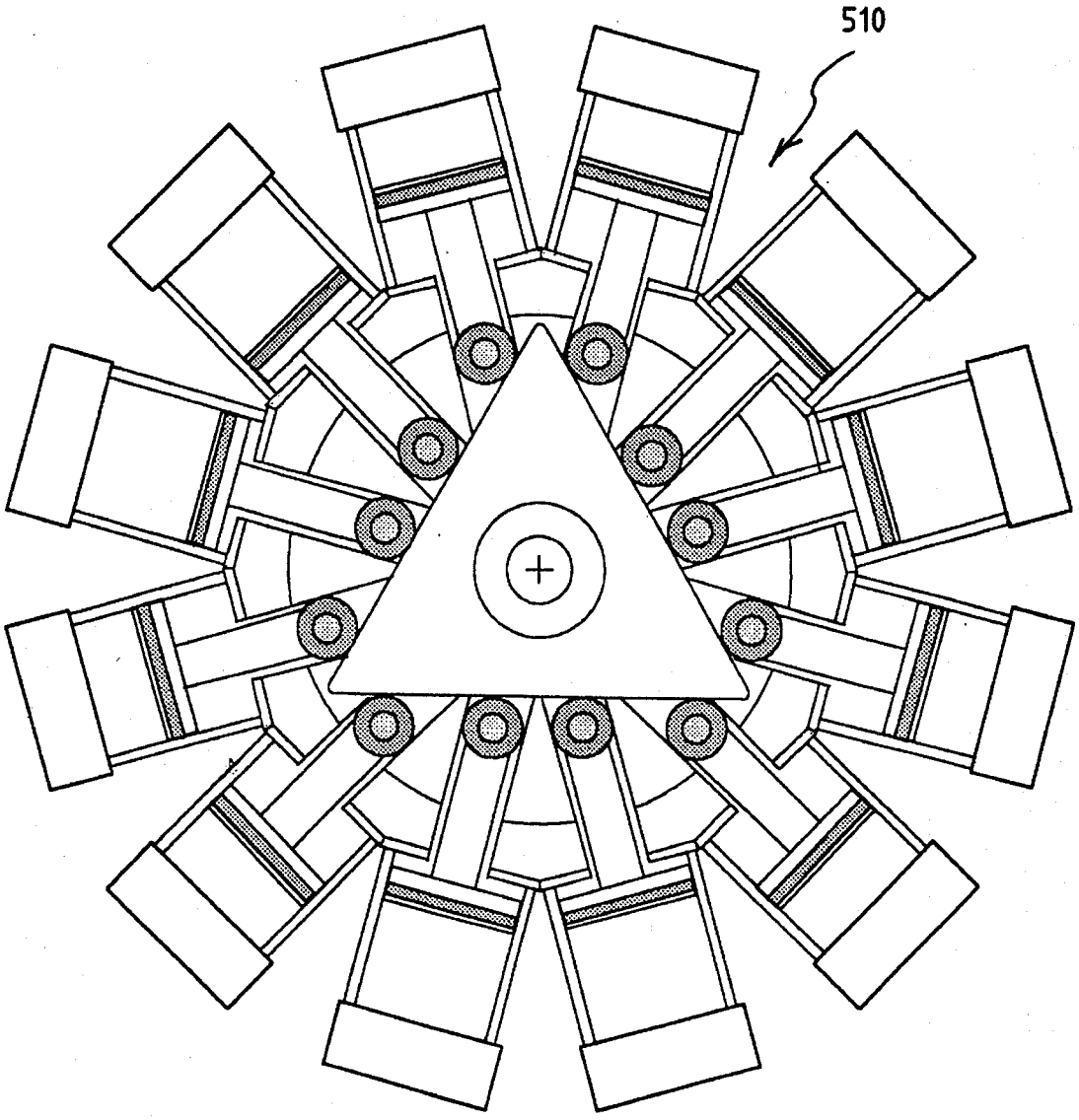
FIG. 8—is similar to FIG. 5, but shows an engine unit with twelve cylinders.

A twelve cylinder engine unit is identified in FIG. 8 by the numeral 510, in which embodiment the cylinders are equispaced apart to extend about an angular interval of 360°. The operation of engine units 410 and 510 is wholly analogous to that of engine unit 310 as described above.

Figure 9A:
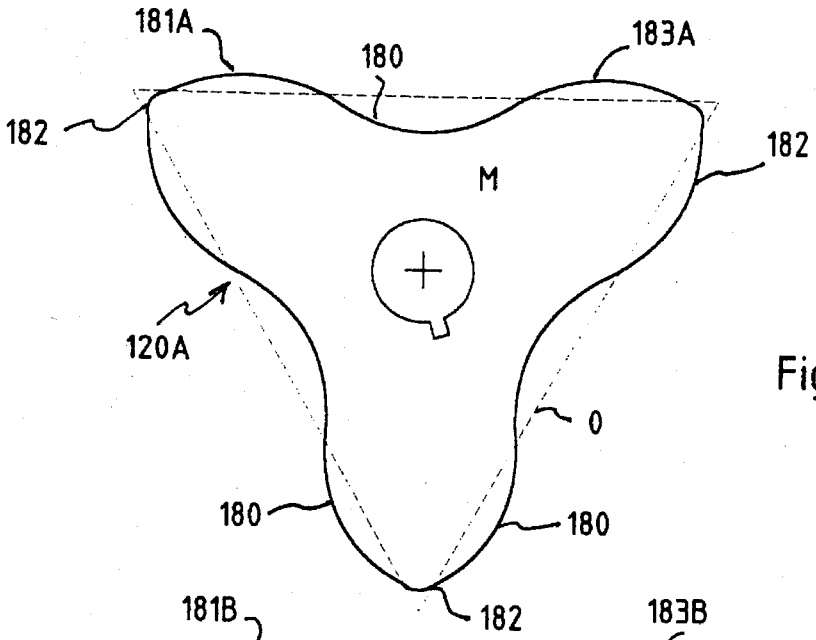
FIG. 9A–9C—show modified cam profiles that may be used with engine units of the invention, including those of the aforementioned copending application.
Figure 10:
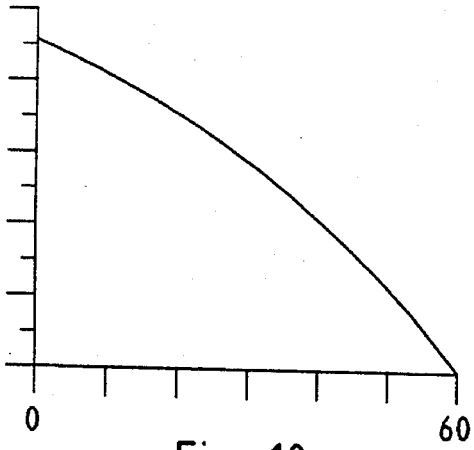
FIG. 10—shows the theoretical torque output per cylinder over the expansion stroke of the cylinder, when using an isosceles triangular cam.
Figure 11A:
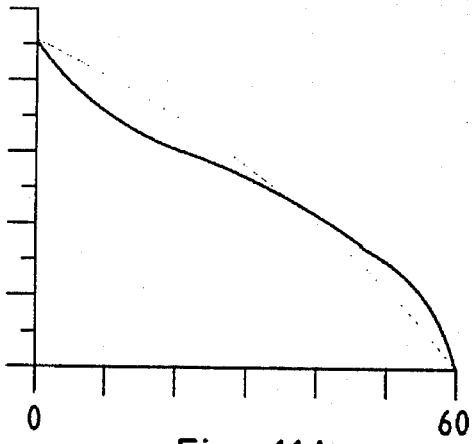
FIGS. 11A–11C—are similar to FIG. 10, but for the respective cam shapes of FIGS. 9A–9C.
Figure 12:
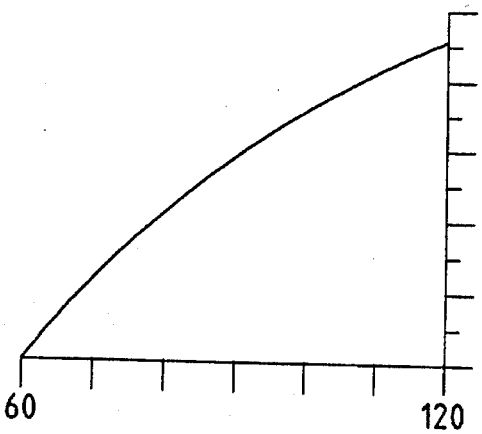
FIG. 12—relates the linear displacement of a position to the angular rotation of the cam over the compression stroke for an isosceles triangular cam.
Figure 13:
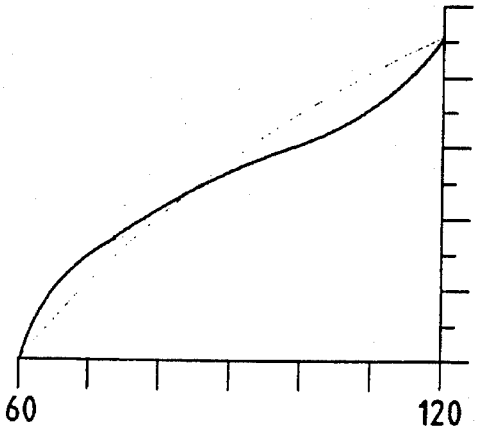
FIG. 13—is similar to FIG. 12, but applies to each of the cam shapes of FIGS. 9A–9C.

Referring now to FIG. 9A, a second embodiment of main cam 20 is identified therein by the numeral 120A, with the basic equilateral, rectilinearly sided shape of similar to that of cam 20 being superimposed in dashed outline denoted by the letter O. Cam 120A has lobes 182, and sides 180 extending between adjacent pairs of lobes. Sides 180 include a first portion 181A extending between a lobe and a mid zone of the side denoted by the letter M, and a second portion 183A extending between the mid zone and the adjacent lobe. In this second embodiment, cam side portions 181A and 183A are identically shaped whereby the sides 180 are fully symmetrical, and cam 120A may rotate in either direction. Assuming an anticlockwise direction, cam side portions 181A will control the movement of a piston such as piston 40 on the power stroke of the engine, the torque output curve thereof being shown in FIG. 11A, and cam side portions 183A will control the movement of the position on the exhaust stroke, as seen in FIG. 13. Comparable curves for the torque output and exhaust stroke, movement for a cylinder in conjunction with an isosceles triangular cam 20 are shown in FIGS. 10 and 12 respectively. Portion 181A has a shallow S-shape, being initially convexly curved; this has the effect of reducing the acceleration of piston 40 in the vicinity of lobe 182 on the power stroke relative to the acceleration produced using cam 20; it also has the effect of flattening the torque output curve whereby the maximum torque output occurs at a later interval in the output stroke, while being sustained over an increased interval. Cam side portion 181 A changes to a concave shape on approach to mid-zone M, which zone is disposed closer to the centre of rotation of cam 120A than in the corresponding cam 20. This has the effect of increasing the length of the power stroke and also the angular interval over which a relatively high torque output is maintained in the output stroke. Cam side portion 183A also has a shallow S-shape. Given that some gas will be trapped within a cylinder to serve as a cushion for a piston within that cylinder on the exhaust stroke and that the gas will be compressed by an effort applied through a piston follower such as 46, this shape of cam side portion 183A serves to locate the angular interval over which the maximum effort is applied in a generally diametric opposition to that over which a maximum torque is output from another cylinder of the engine, to assist in the smooth operation thereof. It will in addition serve to diminish the deceleration of a piston on approach to a lobe 182 on the exhaust stroke.

Figure 9B:
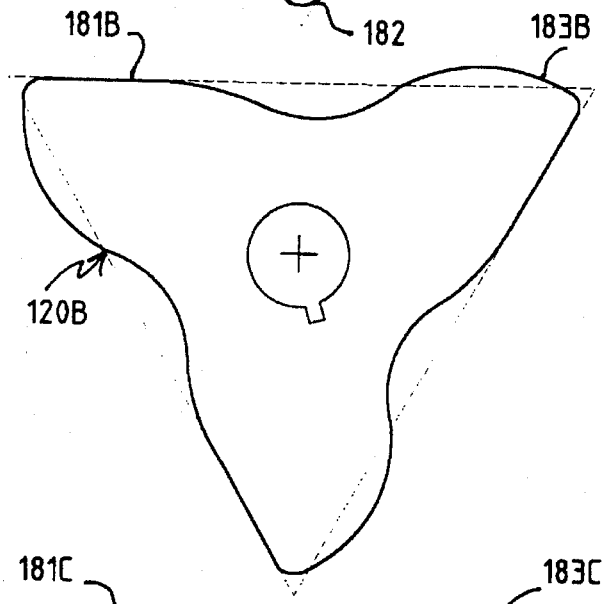
Figure 9C:
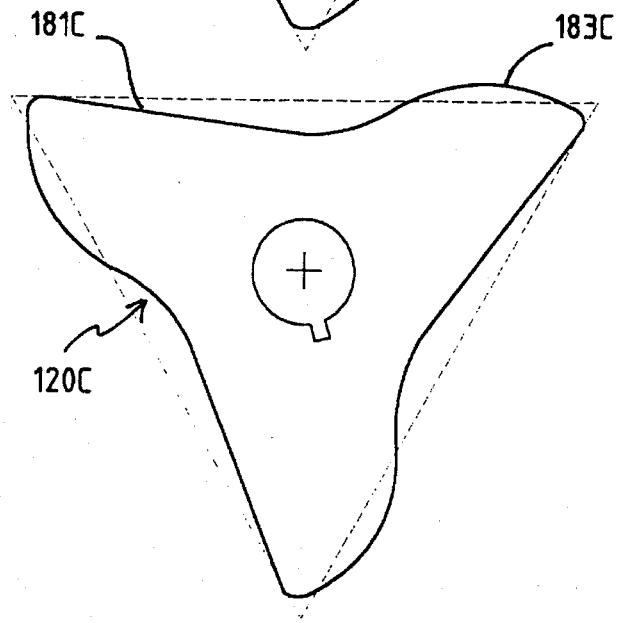
Figure 11B:
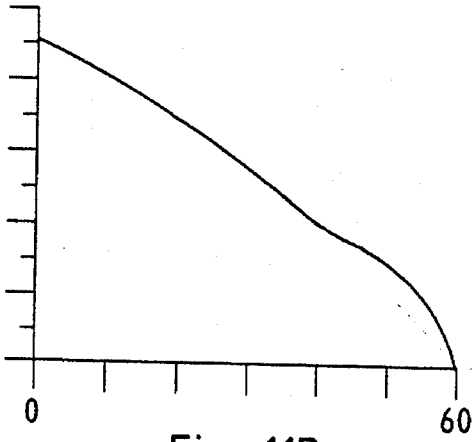
Figure 11C:
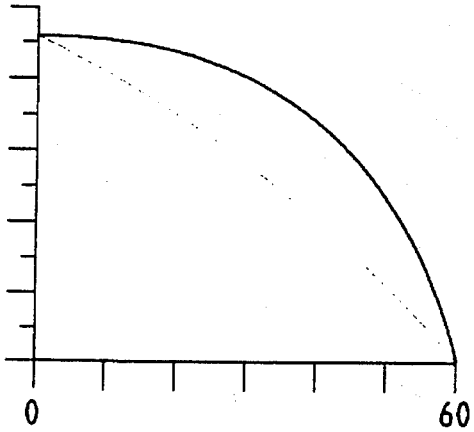

A cam having the shape shown in FIG. 9A may be preferred for moderately high speed, reversible engines 10. However, it will be appreciated that other cam shapes may be preferred, for example that shown in FIG. 9B wherein the initial portion 181B of cam 120B has a fiat and neutral shape in comparison to the basic triangular shape, a cam of this form being suited for medium speed operation. In FIG. 9C a cam 120C is shown wherein the initial portion has a negative incline which is best suited for low speed, high torque engines. The torque output curves for the cams of FIGS. 9B and 9C are illustrated in FIGS. 11B and 11C respectively.

It will be apparent that many changes may be made to the illustrative embodiments while falling within the scope of the invention, and it is intended that all such changes be covered by the claims appended hereto.

I claim:

1. An engine comprising a housing;

shaft means mounted from said housing for rotation relative thereto;

a tri-lobe cam secured to said shaft means within said housing;

piston means mounted on said housing in radial relation to said shaft means;

each said piston means comprising a cylinder, a piston mounted for independent reciprocal movement within said cylinder relative to any other piston and a cam follower connected to said piston;

the improvement wherein N banks of said piston means are provided where N is an integer less than 3, wherein each said bank comprises four piston means wherein the angular interval between the first and last piston means of said bank is 90°.

2. An engine as defined in claim 1 wherein N is equal to 2.

3. An engine as defined in claim 2 wherein adjacent banks of said piston means are spaced apart by an angular interval of 30°.

4. An engine as defined in claim 2 wherein adjacent banks of said piston means are spaced apart by an angular interval of 90°.

5. An engine as defined in claim 1 including second and third banks each of four piston means wherein each said piston means is spaced apart from an adjacent piston means by 30°.

6. An engine as defined in claim 2 wherein each bank of piston means is disposed in the same plane.

7. An engine as defined in claim 3 wherein each bank of piston means is disposed in the same plane.

8. An engine as defined in claim 4 wherein each bank of piston means is disposed in the same plane.

9. An engine as defined in claim 5 wherein each bank of piston means is disposed in the same plane.

10. An engine comprising a housing;

shaft means mounted from said housing for rotation relative thereto;

tri-lobe cam means secured to said shaft means within said housing;

at least four piston means mounted on said housing in radial relation to said shaft means;

each said piston means comprising a cylinder, a piston mounted for independent reciprocal movement within said cylinder relative to any other piston and a cam follower connected to said piston;

the improvement wherein said cam means is concavely curved adjacent the mid zone of each side thereof and wherein said mid zone is disposed radially inwardly of a notional line interconnecting the apices of an adjacent pair of lobes.

11. An engine as defined in claim 10 wherein said at least four piston means form one bank of piston means extending over an angular interval of 90°.

12. An engine as defined in claim 10 wherein said at least four piston means comprises eight piston means forming two banks, with each said bank extending over angular interval of 90°.

13. An engine as defined in claim 12 wherein said banks are spaced apart by an angular interval of 90°.

14. An engine as defined in claim 10 wherein said at least four piston means comprises twelve equi-spaced piston means.

15. An engine as defined in claim 1 wherein N is equal to 1.

16. An engine as defined in claim 15 wherein the piston means are disposed in the same plane.

* * * * *